252-99 AU 166 EX
5/2/78 XR 4,087,369

United States Patent [19]
Wevers

[11] 4,087,369
[45] May 2, 1978

[54] PEROXYBLEACH ACTIVATED DETERGENT COMPOSITION

[75] Inventor: Jean Wevers, Bruxelles, Belgium

[73] Assignee: The Procter & Gamble Company, Cincinnati, Ohio

[21] Appl. No.: 739,404

[22] Filed: Nov. 8, 1976

[51] Int. Cl.[2] ..... C11D 7/54
[52] U.S. Cl. ..... 252/102; 252/89 R; 252/95; 252/99; 427/212; 427/213; 264/4; 425/222
[58] Field of Search ..... 252/89, 94, 95, 99, 252/102, 174; 427/212, 213; 264/4–9; 425/222

[56] References Cited

U.S. PATENT DOCUMENTS

| | | | |
|---|---|---|---|
| 2,992,186 | 7/1961 | Hellstew | 252/99 X |
| 3,163,606 | 12/1964 | Viveen et al. | 252/99 X |
| 3,779,931 | 12/1973 | Fries et al. | 252/99 |
| 4,003,841 | 1/1977 | Hachmann et al. | 252/95 |

*Primary Examiner*—Mayer Weinblatt
*Attorney, Agent, or Firm*—Richard C. Witte; Thomas H. O'Flaherty; David F. Chalmers

[57] ABSTRACT

Granular peroxybleach activated detergent compositions are disclosed containing a crystalline activator component having a well-defined particle diameter and a narrowly defined rate of hydrolysis. These compositions have improved stability, particularly with respect to the activator, under prolonged, particularly alkaline, storge conditions. Peroxybleach activator agglomerates having a specific particle diameter and detergent compositions containing these agglomerates are also disclosed. The agglomerating agent is defined through its inertness versus the activator and also in its melting point. The bleach-activator detergent compositions of this invention are stable under prolonged (alkaline) storage thereby remaining substantially unchanged with respect to the appearance and performance characteristics of the freshly prepared detergent composition.

13 Claims, No Drawings

PEROXYBLEACH ACTIVATED DETERGENT COMPOSITION

BACKGROUND OF THE INVENTION

This invention relates to detergent compositions containing peroxybleach activators. In particular, this invention pertains to detergent compositions comprising particulate crystalline peroxybleach activators having a coarse particle diameter and a well-defined rate of hydrolysis. The particulate peroxybleach activator can also be represented by an agglomerate of a peroxybleach activator and a chemically inert, versus the activator, agglomerating agent having a melting point in the range from about 25° C to about 100° C. Detergent compositions containing the particulate bleach activator, either crystalline or as an agglomerate, of this invention retain their original performance and appearance characteristics after a prolonged storage. The use of oxygen bleach components in detergent formulae is well known and had found widespread commercial acceptance. During the laundering operation, peroxybleach components release the active oxygen at temperatures in the range from about 60° C up to the boil. The active oxygen provides bleaching and cleaning enhancement through chemical interaction with the soil, for example, through oxidation and hydrolytic cleavage. In up to the boil perbleach laundering operations, not all the active oxygen of the peroxybleach component will be released for cleaning and bleaching purposes. In addition, oxygen bleach-containing detergent compositions for up to the boil laundering operations cannot be used effectively in many laundering machines used by housewives.

The above disadvantages are well known and much effort has been spent to provide laundering compositions capable of releasing the active oxygen at a temperature in the range from, for example, ambient temperature to about 60° C. This can be achieved through the incorporation of a peroxybleach activator which is capable of facilitating the active oxygen release at lower temperatures, for example, in the range from about ambient temperature to about 60° C. Concurrently, the activator catalyzes the active oxygen release to obtain a more quantitative use of the peroxybleach component in the detergent composition.

It is well known that peroxybleach activator-containing detergent compositions suffer from activator instability and component-incompatibility due to the chemical affinity of the activator to sensitive co-ingredients, particularly during prolonged storage. These shortcomings apparently relate to the chemical reactivity of the activator, to wit, hydrolysis and perhydrolysis. The activator in conjunction with formula moisture forms undesirable hydrolysis and perhydrolysis products during storage. These (hydrolysis and perhydrolysis) reaction products are, of course, not available for laundering purposes. These products of hydrolysis and perhydrolysis can also react with the more sensitive ingredients in the detergent formulae to thereby render them less effective in achieving their function. Examples of the like components include perfumes, optical brighteners, enzymatic ingredients, dyes, etc. The incompatibility of the optical brightener (or its impurities) in presence of a peroxybleach activator can be a problem in formulating detergent compositions. This can result in the formation of a distinct and undesirable pink or yellow hue in the finished product.

The peroxybleach activator materials currently available being deficient for the reasons set out hereinbefore, there is a standing desire to formulate low-temperature bleach detergent compositions which provide the expected advantages of low-temperature bleach compositions, but at the same time do not possess the shortcomings which render them less attractive for commercialization.

It is a main object of this invention to provide an activated bleach detergent composition having an improved stability and a superior performance after a prolonged storage.

It is an additional object of this invention to provide an activated bleach detergent composition the appearance of which will remain substantially unchanged (storage stable) even in the presence of an optical brightener.

The above and other advantages, as is apparent from the following description, can be provided by the invention disclosed hereinafter.

It has now been discovered that granular activated peroxybleach containing detergent compositions can be prepared having desirable storage stability, appearance and performance properties.

In more detail, this invention broadly encompasses the addition of a particulate perbleach activator, having a narrow particle diameter and a specific rate of hydrolysis to a peroxybleach detergent composition. The activator either can meet the definition of this invention as a uniform and coarse crystalline activator component or as an agglomerate of a finely divided activator and a suitable agglomerating agent. The peroxybleach activator is further characterized by a rate of hydrolysis in the range from about 45% to 5% by weight under the testing conditions set forth in the following.

The essential and some additional components of this invention are described in more details hereinafter.

Unless indicated to the contrary in the following description of the invention the "%" indications stand for percent by weight.

The perbleach activator component herein can be represented by a crystalline species having a mean particle diameter in the range from about 1.8 mm to about 0.5 mm, preferably from 1.6 mm to about 1.0 mm. An average particle diameter of more than about 1.8 mm has been found to be less suitable for use in detergent compositions because of an increased tendency to segregate and also because the dissolving speed can diminish to the point where it could not anymore provide all the advantages of this invention within the time limit of the laundering operation. The lower particle diameter appears to be critical inasmuch as a crystalline activator component having a mean particle distribution of less than 0.5 mm is prone to a markedly decreased storage stability which, of course, can adversely affect the appearance and performance characteristics of, for example, the detergent composition into which the activator, either crystalline or as an agglomerate, is incorporated.

The average particle diameter can be selected and determined with the aid of the usual means incluse of sieves (any calibrated series), microscopic determinations and so on.

The activator component is furthermore defined by its loss of activity which can be measured with the following analytical technique.

DETERMINATION OF THE RATE OF HYDROLYSIS OF THE ACTIVATORS 500 ml of a detergent solution is prepared by dissolving 2 gr of a detergent base powder in deionized water. The base powder contains all ingredients of a usual peroxybleach containing detergent composition except the peroxybleach component. This detergent solution is maintained at 20° C and pH 4 under continuous stirring. $7.46 \times 10^{-3}$ moles activator is then added to the detergent solution having the pH and temperature defined above. After 7 minutes the pH is adjusted to 9.7; this moment is termed $t=0$ for the determination of the rate of hydrolysis.

After a hydrolysis time of 60 minutes, a 10 ml aliquot of the activator-detergent solution is added to 100 ml of an aqueous solution containing 0,18 g sodiumperborate tetrahydrate and 1,6 g of tetrasodiumpyrophosphate. After 15 minutes, about 100 g crushed ice and 15 ml of glacial acetic acid are added to the mixture so prepared. The rate of hydrolysis is determined iodometrically by adding 0,3 g of potassium iodide to the solution followed by immediate back-titration with sodium thiosulfate (0.1 N or 0.05 N depending upon the activator) in presence of a suitable indicator.

As already mentioned, any detergent base powder containing the usual detergent components, used in bleaching detergent compositions, minus the peroxybleach component can serve for the determination of the rate of hydrolysis of the activator.

Suitable peroxybleach activators for use in the compositions of this invention have a rate of hydrolysis in the range from 45% to 5% preferably from 30% to 8%. Examples of preferred activators herein include tetra-acetyl ethylene diamine (rate of hydrolysis 28%); sodium p-benzyloxybenzene sulfonate (rate of hydrolysis 24%); and acetylsalicylic acid (rate of hydrolysis 13%). Various other activators can meet the definition of this invention i.e. the rate of hydrolysis and the particle distribution. However, many commercially available peroxybleach activators do not meet the definition of this invention, particularly as regards the rate of hydrolysis. Among the better known activator species, this applies particularly to tetra-acetyl glycoluril (rate of hydrolysis 60%); and sodium p-acetoxybenzene sulfonate (rate of hydrolysis 53%). It is important to note that the activator selection is based on two properties which are unrelated. The rate of hydrolysis defines the stability in solution irrespective of the crystallinity and particle distribution.

The activator component can also be used as an agglomerate of a peroxybleach activator, having a rate of hydrolysis in the range from about 45% to about 5%, preferably from 30% to 8%, and an agglomerating agent which is chemically inert versus the activator and has a melting point in the range from 25° C to 100° C, preferably from 35° C to 100° C. The weight ratio of activator component to agglomerating agent is normally in the range from about 1:5 to 50:1, preferably from 1:1 to 10:1. The activator-agglomerate has an average particle distribution in the range from about 2,6mm to about 0.3mm, preferably from 1,8mm to about 0,8mm.

Specific examples of agglomerating agents suitable for use in this invention are 1. The condensation products of one mole of a saturated or unsaturated, straight or branched chain carboxylic acid having from about 10 to about 18 carbon atoms with from about 20 to about 50 moles of ethylene oxide, which liquefy between the temperatures of about 35° C and about 100° C. The condensation product of one mole of coconut fatty acid having the approximate carbon chain length distribution of 2% $C_{10}$, 66% $C_{12}$, 23% $C_{14}$ and 9% $C_{16}$ with 35 moles of ethylene oxide is a specific example of an agent containing a mixture of different chain length fatty acid moieties. Other specific examples of materials of this type are: the condensation products of one mole of palmitic acid with 40 moles of ethylene oxide; the condensation product of one mole of myristic acid with 35 moles of ethylene oxide; the condensation product of one mole of oleic acid with 45 moles of ethylene oxide; and the condensation product of one mole of stearic acid with 30 moles of ethylene oxide.

2. The condensation products of one mole of a saturated or unsaturated, straight or branched chain alcohol having from about 10 to about 24 carbon atoms with from about 10 to about 50 moles of ethylene oxide, which liquefy between the temperatures of about 35° C and 100° C. and are solid at temperatures below 35° C. The condensation product of one mole of coconut alcohol having the approximate chain length distribution of 2% $C_{10}$, 66% $C_{12}$, 23% $C_{14}$ and 9% $C_{16}$ with 45 moles of ethylene oxide ($CNAE_{45}$) is a specific and highly preferred example of an agent containing a mixture of different chain length alcohol moieties. Other specific examples of materials of this type are the condensation products of one mole of tallow alcohol with 20 moles of ethylene oxide; the condensation products of one mole of lauryl alcohol with 35 moles of ethylene oxide; the condensation products of one mole of myristyl alcohol with 30 moles of ethylene oxide; and the condensation products of one mole of oleyl alcohol with 40 moles of ethylene oxide.

3. Amides which have a melting point between about 35° C and 100° C are also suitable for use in this invention. Specific examples include propyl amide and N-methyl amides having an acyl chain length of from about 10 to about 15 carbon atoms.

4. The polyethylene glycols having a molecular weight of from about 1400 to about 30,000. For example, Dow Chemical Company manufactures these materials in molecular weights of 20,000, 9500, 7500, 4500, 3400 and 1450. All of these agents are waxlike, solids which melt between 35° C and 100° C.

5. The condensation products of one mole of alkyl phenol wherein the alkyl chain contains from about 8 to about 18 carbon atoms with from about 25 to about 50 moles of ethylene oxide.

6. Fatty acids containing from about 12 to about 30 carbon atoms which melt between 35° C and 100° C. Specific examples of these agents are lauric acid, myristic acid, palmitic acid, stearic acid, tallow acid or mixtures of tallow acid and coconut acid, arachidic acid, behenic acid and ligoceric acid.

7. Fatty alcohols containing from about 16 to about 30 carbon atoms which melt between 35° C and 100° C. Specific examples of these agents are 1-hexadecanol, 1-octadecanol, 1-eicosanol, 1-heneicosanol, 3-docosanol, 1-tetracosanol and 1-octaosanol.

Normally solid agglomerating agents other than those listed above can also be used in this invention provided they are compatible (inert versus) with the activator and melt within the ranges specified.

The activator agglomerates can be prepared by contacting a softened or molten agglomerating agent with the activator. In a preferred preparation technique, the molten agglomerating material having a temperature in the range from about 60° C to 80° C is sprayed onto the activator in a pan granulator. Many other devices and techniques for contacting the materials can be used without adversely affecting the stability of the activator. Suitable examples of the like alternate methods include drum agglomeration techniques, fluidized bed spray-on and falling curtain spray-on. These alternate techniques are eminently well known to the men of art.

The activator component i.e. the crystalline activator species or the agglomerate of a crystalline activator and a suitable agglomerating agent, is normally used in an amount from about 0.5% to about 20%, preferably from about 2% to 8% of the detergent composition. The weight ratio of the activator component to the peroxybleach component is normally in the range from 1:1 to 1:20, preferably from 1:2 to 1:8.

The activator component, especially the agglomerate, can also be commercialized as such for the purpose of using it as an additive to a non-activated peroxybleach containing detergent. However, preferably, the activator of this invention is commercialized in conjunction with a peroxybleach containing detergent composition in the relative amounts specified above.

The detergent compositions, in addition to the activator component, comprise a surface-active agent; a detergent builder component; a peroxybleach component; and, if desired, additional ingredients with a view to complement and perfect the overall stability and performance of the subject compositions.

The surface-active agents suitable herein can be selected from the group consisting of anionic, nonionic, ampholytic, zwitterionic surfactants and mixtures thereof. The surface-active component is normally used in an amount from 3% to 45%, preferably from 6% to 25%. A listing of examples of surface-active components which can be used in the preferred compositions herein appears in U.S. Pat. No. 3,664,961 to Russell NORRIS, granted May 23, 1972, incorporated herein by reference.

Especially preferred are anionic and/or nonionic surface-active agents. Preferred anionic surfactants include the alkali-metal salts of linear alkylbenzene sulfonates wherein the alkyl chain has from 9 to 15 carbon atoms, alkylsulfates having from 10 to 20 carbon atoms in the alkylchain, and paraffin sulfonates having from 10 to 20 carbon atoms. Preferred nonionic surfactants include the organic surfactants having the formula $R(OC_xH_{2x})_n OH$ wherein R represents an alkyl or alkenyl group having from 8 to 22 carbon atoms or an alkylated or alkenylated phenyl group having from 6 to 12 carbon atoms in the alkyl or alkenyl group, $x$ is 2 or 3 and $n$ ranges from 1 to 8.

The detergent builder component normally represents from about 5 % to about 70 %, preferably from about 8 % to about 45 % of the detergent composition. The builder ingredient can be represented by all conventional inorganic and organic detergent builder components which are known to be suitable for use in the like compositions. Suitable builder components include the water-soluble salts of phosphates, pyrophosphates, orthophosphates, polyphosphates, phosphonates, carbonates, polyhydroxysulfonates, polyacetates, carboxylates, polycarboxylates and succinates. Specific examples of inorganic phosphate builders include sodium and potassium tripolyphosphates, pyrophosphates, phosphates, and hexametaphosphates. The polyphosphonates specifically include, for example, the sodium and potassium salts of ethylene diphosphonic acid, the sodium and potassium salts of ethane 1-hydroxy-1, 1-diphosphonic acid and the sodium and potassium salts of ethane-1, 1, 2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference.

Other preferred non-phosphorus builder materials herein include sodium carbonate, sodium bicarbonate, sodium citrate, sodium oxydisuccinate, sodium mellitate, sodium nitrilotriacetate, sodium ethylenediaminetetra-acetate, and mixtures thereof. Additional preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol trisulfonate.

A further preferred builder component herein is represented by the water-insoluble synthetic aluminosilicate ion-exchange materials more fully described in Belgian Pat. No. 814,874 to CORKILL et al., granted November 12, 1974, incorporated herein by reference. Mixtures of these synthetic aluminosilicates in combination with conventional detergent builders can represent another very desirable builder component herein.

The peroxybleaching component can be represented by all organic and inorganic oxybleaching agents which are commonly used in detergent technology and which are known to be suitable for use in the like compositions. Well-known bleaching component are represented by the peroxyhydrates and include perortho-, perpyro-, and perpolyphosphates. Percarbonates and hydrogen peroxy adducts, for example, peroxide-urea adducts, can also be used. The alkali metal salts of perborate, percarbonate, persilicate, perphosphate and mixtures thereof are useful therein. Particularly preferred because of their commercial availability are alkalimetalperborates such as the tetrahydrates and the monohydrate. The peroxybleach component can be used in an amount from about 4 % to about 80 %, preferably from about 8 % to about 25 %. In addition to the essential components described hereinbefore, the compositions of this invention can comprise a series of additional components to perfect and complement the performance advantages derivable from the combination of essential components.

These additional components include suds regulating agents, brighteners, dyes, perfumes, bactericides, processing aids, antioxidants, corrosion inhibitors, enzymes and so on.

The suds regulating agents are normally in an amount from 0.05 to 10 %, depending, among others, upon the physical and chemical properties of the component selected. $C_{16}$-$C_{22}$ fatty acids are frequently used in an amount from 2% to 6 %.

A preferred suds regulating agent is represented by the silicone containing regulators of Belgian Pat. No. 803,101 to Bartolotta et al., granted Feb. 1, 1974 incorporated herein by reference. These preferred regulators are normally used in an amount from 0.05 to 2%. Another preferred suds regulating agent is represented by microcrystalline waxes having a melting point in the range from 35° C–115° C and a saponification value of less than 100. The microcrystalline waxes are substantially water-insoluble, but are water-dispersible in the presence of surface-active agents. Preferred microcrystalline waxes have a melting point from about 65° C to 100° C, a molecular weight in the range from 400-1.000; and a penetration value of at least 6, measured at 77° F by ASTM-D1321. Suitable examples of the above waxes include microcrystalline and oxidized microcrystalline-petrolatum waxes; Fischer-Tropsch and oxidized Fisher-Tropsch waxes, ozokerite, ceresin, montan wax, bees wax, candellila; and carnauba wax. It may be desirable to add a copolymeric processing aid. This component can be represented by a water-soluble derivative of a copolymer of a (1) vinyl compound having the general formula RCH = CHR wherein one R represents a hydrogen atom and the other R represents either an alkyl radical containing from one to about 4 carbon atoms or a hydrogen atom; and (2) maleic anhydride. The copolymeric vinyl ingredient is normally used in an amount from about 0.1 % to about 6 %, preferably from 0.25 % to 4 %. Specific examples of these copolymeric ingredients include a water-soluble acid, an alkali-metal salt of that acid, an ester, or a $C_{1-2}$ alkyl- or alkylolamide of a maleic anhydride-vinyl $C_{1-4}$ alkyl ether copolymer. The specific viscosity of, for example, the maleic anhydride-vinyl $C_{1-4}$ alkyl ether copolymer for use herein preferably varies between 0,1 and 6, most preferably between 0.2 and 5.0; the specific viscosity is defined by measuring the viscosity of the solution of 1 g of the anhydride copolymer in 100 ml methylethylketone at 25° C in a series 100 CANNON-FENSKE viscosity meter. With this copolymeric component, the detergent product has improved physical properties including flowability.

Another optional ingredient is a mixture of alkoxylated mono- and diesters of phosphoric acid. This mixture is normally used in an amount from 0.5 % to 20 % by reference to the sum of the nonionic surface-active agents. These phosphoric esters are preferably represented by alkoxylated fatty alcohols having from 10 to 22 carbon atoms with 2 to 15 moles ethylene oxide or propolyne oxide. The weight ratio of monophosphoric to diphosphoric esters is usually in the range from 6:1 to 3:1, preferably 4:1.

It may also be desirable, especially if nonionic surface-active agents are mixed in prior to the spray-drying operation, to incorporate from 0.01 % to 10 %, expressed by reference to the nonionic surfactant of, an antioxidant. Suitable examples of antioxidant materials are disclosed in German patent application DAS 1,617,209. A preferred antioxidant material is 4,4'-thiobis(6-tert-butyl-m-cresol).

The detergent composition can additionally contain an enzymatic ingredient. Proteases, amylases and lipases can be added in an amount from 0.001 % to about 5 % to augment and aid in the cleaning activity of the bleaching detergent compositions herein. Preferred proteolytic enzymes are disclosed in Belgian Pat. No. 775.854, to EYMERY et al., granted May 26, 1972.

EXAMPLE I

A granular detergent composition was prepared by conventional spraydrying a detergent slurry containing the following ingredients.

| INGREDIENT | PARTS BY WEIGHT |
|---|---|
| Linear dodecylbenzene-sulfonate sodium salt | 6 |
| Tallow alkylsulfate sodium salt | 3 |
| Substantially hydrogenated $C_{16}$-$C_{12}$ fatty acid (HYFAC) | 4 |
| Anhydrous sodium tripolyphosphate | 28 |
| Silicate solids : $SiO_2/Na_2O=2/1$ | 9 |
| Condensate of one mole of tallow alcohol and 11 moles of ethylene oxide | 3 |
| Disodium 4,4-di(2''-anilino-4''-morpholino-triazin-6''-ylamino)-stilben-2,2'-disulfonate | 0.3 |
| Sodium sulfate | 14 |
| Moisture (remaining in product after spray-drying) | 6 |
| Carboxymethylcellulose sodium salt | 1 |
| Sodium ethylene diamine tetra-acetate | 0.3 |

A series of additional components, which had been prepared/granulated separately, were dry-mixed to the granular detergent base-powder so prepared.

| INGREDIENT | PARTS BY WEIGHT |
|---|---|
| Marumerized proteolytic enzyme (maxatase-expressed on 1.5 Anson/units) | 0.3 |
| Sodium perborate tetrahydrate | 18 |
| Activator agglomerate containing* tetra-acetyl ethylene diamine 4-condensate of one mole of tallow alcohol and 25 moles of ethylene oxyde 1 | 5 |

*mean particle diameter of activator agglomerate: 1.4 mm.

The above composition remains substantially unchanged with respect to product appearance after a prolonged storage; it additionally provides superior cleaning performance, especially bleach-stain removal by reference to what is obtained from an identical composition containing the same activator which was not agglomerated and had a mean particle diameter of 0.2 mm, subject to the same storage conditions.

A granular detergent base-powder was prepared by spray-drying in a conventional manner a detergent slurry having the following formula:

| INGREDIENT | PARTS BY WEIGHT |
|---|---|
| Condensate of a blend of a 1:1 synthetic $C_{14}$-$C_{15}$ alcohol and 7 moles of ethylene oxide | 14 |
| Anhydrous sodium tripolyphosphate | 32 |
| Silicate solids : $SiO_2/Na_2O=2/1$ | 5 |
| Sodium carboxy methyl cellulose | 0.9 |
| Sodium ethylene diamine tetra-acetate | 0.3 |
| Disodium 4,4'-di(2''-anilino-4''-morpholinotriazin-6''-ylamino)-stilben-2,2' disulfonate | 0.2 |
| Sodium sulfate + miscellaneous | 18 |
| Moisture (expressed as residual moisture in the spray-dried base-powder). | 7 |

The detergent base-powder so-prepared was dry-mixed with a series of granular ingredients which had been prepared individually. These additional ingredients were:

| INGREDIENT | PARTS BY WEIGHT COMPOSITION A | PARTS BY WEIGHT EXAMPLE II |
|---|---|---|
| Marumerized proteolytic enzyme prills (activity : 1.5 Anson/units) | 0.3 | 0.3 |
| Sodium perborate tetrahydrate | 18 | 18 |
| Tetra acetyl ethylene diamine -mean particle diameter:0.14mm | 4 | |
| -mean particle diameter:1.4 mm | | 4 |

The above products, Composition A being representative of the state of the art and Example I according to this invention, were submitted to an accelerated storage test packed in wax laminated cardboard at 35° C and 80% relative humidity.

The appearance and residual activator level in both products were determined after 4 and 8 weeks. The appearance was measured with a HUNTER COLORIMETER wherein L represents a measure of whiteness (L:100 = perfect white; L:0 = black);

*a* is a measure of green; +*a* indicates redness;

*b* is a measure of blue; and +*b* indicates yellowness.

The HUNTER COLORIMETER was supplied by Gardner Laboratory, Bethseda, Maryland, USA.

For more information concerning the evaluation of HUNTER color differences, see also:

D. B. JUDD AND G. WYSZECKI; "Color in Business, Science and Industry" 2nd Edition, page 294; Editor : John Wiley and Sons, Inc. - NEW-YORK/-LONDON.

The activator level was determined by infrared spectroscopy whereby the residual acetyl groups (in the activator) were measured. The experimental results were as follows:

| | STORAGE TIME | COMPOSITION A | | | EXAMPLE II | | |
|---|---|---|---|---|---|---|---|
| ACTIVATOR LEVEL in FINISHED product (in % of composition) | 4 weeks | 1.5 | | | 3.6 | | |
| | 8 weeks | 0 | | | 3.5 | | |
| | | L | a | b | L | a | b |
| COLOR VARIATION (Hunter measurement) | 0 week | 94.0 | 3.0 | −4.7 | 94.0 | 3.0 | −4.7 |
| | 4 weeks | 94.0 | −1.4 | 6.8 | 94.0 | 2.1 | −2.2 |
| | 8 weeks | 94.0 | −2.0 | 7.3 | 94.0 | 1.6 | −0.7 |

The examples clearly show the markedly superior appearance and activator stability derived from the compositions according to this invention — EXAMPLE II — versus a prior art composition — COMPOSITION A —. It indeed is clearly apparent that the composition of EXAMPLE II is outstandingly stable to the point where the activator level is but slightly decreased under lasting and severe storage conditions. It is also noteworthy that the prior art composition becomes markedly yellowish which is undesirable from an aesthetic point of view.

EXAMPLE III

A granular detergent composition was prepared by spray-drying an aqueous slurry of the following ingredients:

| INGREDIENT | PARTS BY WEIGHT |
|---|---|
| Sodium linear dodecyl benzene sulphonate | 8.0 |
| Condensate of one mole of tallow alcohol and 11 moles of ethylene oxide | 2.0 |
| Substantially hydrogenated $C_{16}$–$C_{22}$ fatty acid (HYFAC) | 3.0 |
| Anhydrous sodium tripoly phosphate | 35.0 |
| Sodium carboxy methyl cellulose | 1.0 |
| Sodium ethylene diamine tetra-acetate | 0.3 |
| Disodium 4,4'-di(2"-anilino-4" morpholinotriazin-6"-ylamino)-stilben-2,2' disulfonate | 0.2 |
| Sodium sulphate | 7.5 |
| Moisture (remaining in product after spray-drying) | 8.0 |

The granular detergent base-power so-prepared was dry-mixed with a series of additional components which had been prepared/granulated separately.

| INGREDIENT | | PARTS BY WEIGHT |
|---|---|---|
| Sodium perborate tetrahydrate | | 25.0 |
| Activator agglomerate containing (mean particle diameter of activator agglomerate: 1.3 mm) | | |
| acetyl salicylic acid | 8 | 10 |
| condensate of one mole of tallow alcohole and 25 moles of ethylene oxide | 2 | |

The above composition was tested after 4 and 8 weeks under ambient storage conditions. It was found that the activator level had remained substantially unchanged by reference to the level added; and also that the appearance of the detergent composition had not undergone noticeable changes.

EXAMPLE IV

A detergent composition which is substantially similar to the composition of EXAMPLE III was prepared wherein the acetyl salicylic acid in the activator agglomerate was replaced with a substantially equivalent amount of sodium p-benzyloxybenzene sulfonate. This composition also exhibited an outstanding activator stability during prolonged storage and a product appearance which was substantially unchanged.

What is claimed is:

1. A granular peroxybleach-activated detergent composition having improved storage stability, particularly under alkaline conditions, consisting essentially of:

a. from about 3% to about 45% by weight of the composition of an organic surface-active agent selected from the group of anionic, nonionic, ampholytic, and zwitterionic surface-active agents, and mixtures thereof;

b. from about 5% to about 70% by weight of the composition of a detergent builder component;

c. from about 4% to about 80% by weight of the composition of a peroxybleach component; and d. from about 0.5% to about 20% by weight of the composition of a particulate crystalline peroxybleach activator having a mean particle diameter in the range from about 1.8 mm to about 0.5 mm, and a rate of hydrolysis in the range from about 45% to about 5% by weight, determined by dissolving 7.46 $\times 10^{-3}$ moles of said activator in 500 mls. of a continuously stirred 0.4% w/v detergent solution at 20° C and ph 4 for seven minutes, said detergent solution being free of any peroxybleach component, then adjusting said ph to 9.7, and 60 minutes after said pH adjustment, determining the amount of activator which has hydrolyzed.

2. The detergent composition in accordance with claim 1 wherein the peroxybleach activator has an average particle diameter in the range from about 1.6 mm to about 1.0 mm.

3. The detergent composition in accordance with claim 2 wherein the peroxybleach component is selected from the group consisting of the alkali metal salts of perborate, percarbonate, persilicate, perphosphate and mixtures thereof.

4. The detergent composition in accordance with claim 3 wherein the peroxybleach activator has a rate of hydrolysis in the range from about 30% to about 8% by weight.

5. The detergent composition in accordance with claim 4 wherein the peroxybleach activator is selected from the group consisting of tetra-acetyl ethylene diamine; acetyl salicylic acid; sodium p-benzyloxybenzene sulfonate; and mixtures. thereof.

6. A particulate additive suitable for incorporation into a peroxybleaching detergent composition consisting essentially of:

a. a peroxybleach activator having a rate of hydrolysis in the range from about 45% to about 5% by weight, determined by dissolving $7.46 \times 10^{-3}$ moles of said activator in 500 mls. of a continuously stirred 0.4% w/v detergent solution at 20° C and ph 4 for seven minutes, said detergent solution being free of any peroxybleach component, then adjusting said pH to 9.7, and 60 minutes after said pH adjustment, determining the amount of activator which has hydrolyzed;

b. an agglomerating agent which is chemically inert versus said activator, said agglomerating agent having a melting point in the range from about 25° C to about 100° C, the weight ratio of said activator to said agglomerating agent being in the range from about 1:5 to about 50:1; said particulate additive having a mean particle diameter in the range from about 2.6 mm to about 0.3 mm.

7. The particulate additive in accordance with claim 6 wherein the peroxybleach activator has a rate of hydrolysis in the range from about 30% to about 8% by weight and wherein the ratio of said activator to said agglomerating agent is in the range from 1:1 to 10:1.

8. The particulate additive in accordance with claim 7, wherein the peroxybleach activator is selected from the group consisting of tetra-acetyl ethylene diamine; acetyl salicylic acid; sodium p-benzyloxybenzene sulfonate and mixtures thereof.

9. A granular peroxybleach-activated detergent composition having improved storage stability, particularly under alkaline conditions, consisting essentially of:

a. from about 3% to about 45% by weight of the composition of a surface-active agent selected from the group consisting of anionic, nonionic, ampholytic, zwitterionic detergents and mixtures thereof;

b. from about 5% to about 70% by weight of the composition of a detergent builder component;

c. from about 0.5% to about 20% by weight of the composition of a peroxybleach activator agglomerate comprising:

i. a peroxybleach activator having a rate of hydrolysis in the range from about 45% to about 5% by weight, determined by dissolving $7.46 \times 10^{-3}$ moles of said activator in 500 mls. of a continuously stirred 0.4w/v detergent solution at 20° C and ph 4 for seven minutes, said detergent solution being free of any peroxybleach component, then adjusting said pH to 9.7, and 60 minutes after said pH adjustment, determining the amount of activator which has hydrolyzed;

ii. an agglomerating agent which is chemically inert versus said activator, said agglomerating agent having a melting point in the range from about 25° C to about 100° C, the weight ratio of said activator to said agglomerating agent being in the range from about 1:5 to about 50:1; said activator agglomerate having an average particle diameter in the range from about 2.6 mm and about 0.3 mm;

d. from about 4% to about 80% by weight of the composition of a peroxybleach component; and e. from 0% to about 10% by weight of the composition of a suds regulating agent.

10. The detergent composition in accordance with claim 9, wherein the surface active component represents from 6% to 25% by weight; the detergent builder component from 8% to 45% by weight; and the peroxybleach component from 8% to 25% by weight.

11. The detergent composition in accordance with claim 10, wherein the activator agglomerate represents from 2% to 8% by weight; and wherein the activator has a rate of hydrolysis in the range from 30% to 8% by weight.

12. The detergent composition in accordance with claim 11 wherein the suds regulating agent is from 0.05% to about 10% by weight of the composition.

13. The detergent composition in accordance with claim 12, wherein the activator agglomerate has an average particle diameter from 1.8 mm to 0.8 mm, the activator component being selected from the group consisting of tetra-acetyl ethylene diamine acetyl salicylic acid; sodium p-benzyloxybenzene sulfonate; and mixtures thereof.

* * * * *